US006684054B1

(12) United States Patent
Worthy

(10) Patent No.: US 6,684,054 B1
(45) **Date of Patent: *Jan. 27, 2004**

(54) SYSTEM AND METHOD FOR DETECTING HARMONICS OF RF BROADCAST STATION SURVEY SIGNALS

(76) Inventor: David G. Worthy, 819 East Vaughn, Gilbert, AZ (US) 85234

( * ) Notice: Subject to any disclaimer, the term of this patent is extended or adjusted under 35 U.S.C. 154(b) by 568 days.

This patent is subject to a terminal disclaimer.

(21) Appl. No.: 09/710,792

(22) Filed: Nov. 9, 2000

(51) Int. Cl.[7] ..... H04H 9/00
(52) U.S. Cl. ..... 455/2.01; 455/67.11; 455/150.1
(58) Field of Search ..... 455/2.01, 67.11, 455/423, 424, 425, 226.1, 226.4, 150.1, 154.1, 161.1; 725/9, 10, 11, 14, 15, 17

(56) References Cited

U.S. PATENT DOCUMENTS

| | | | | |
|---|---|---|---|---|
| 3,434,150 A | | 3/1969 | Wernlund et al. | 346/1 |
| 4,425,578 A | * | 1/1984 | Haselwood et al. | 725/14 |
| 4,577,220 A | | 3/1986 | Laxton et al. | 358/84 |
| 4,599,644 A | | 7/1986 | Fischer | 358/84 |
| 4,618,995 A | | 10/1986 | Kemp | 455/2 |
| 4,723,302 A | * | 2/1988 | Fulmer et al. | 725/15 |
| 4,955,070 A | | 9/1990 | Welsh et al. | 455/2 |
| 5,410,724 A | | 4/1995 | Worthy | 455/2 |
| 5,561,835 A | | 10/1996 | Worthy | 455/2 |
| 5,749,043 A | | 5/1998 | Worthy | 455/2 |
| 5,819,155 A | | 10/1998 | Worthy et al. | 455/2 |
| 5,839,050 A | | 11/1998 | Baehr et al. | 455/2 |

* cited by examiner

*Primary Examiner*—Quochien Vuong
(74) *Attorney, Agent, or Firm*—Gerry J. Elman; Elman Technology Law, P.C.

(57) ABSTRACT

A survey system (52, 154) is configured to identify radio stations (92) to which tuners (26) are tuned. The tuners (26) have predetermined signals (30) emitted therefrom. In one embodiment, the survey system (52) employs a method (86) which includes selecting one of the predetermined signals (30), receiving at a receiver (54) a second signal (116), and determining that one of the tuners (26) is tuned to one of the radio stations (92) when a harmonic (44, 46) of the fundamental frequency (42) of the predetermined signal (30) is detected within the second signal (116). In an alternative embodiment, the survey system (154) employs a method (182) that includes generating and broadcasting a survey signal (162) that is a one of the predetermined signals (30) modified to incorporate a signal identifier (212, 216). The method (182) further includes detecting a harmonic (44, 46) of the fundamental frequency (42) of the predetermined signal (30) within a received second signal (164) and determining that one of the tuners (26) is tuned to one of the radio stations (92) when the detected harmonic (44, 46) includes the signal identifier (212, 216).

21 Claims, 14 Drawing Sheets

SYSTEM AND METHOD FOR DETECTING HARMONICS OF RF BROADCAST STATION SURVEY SIGNALS

RELATED INVENTION

The present invention is related to "Active System and Method For Detecting Harmonics of RF Broadcast Station Survey Signals", by David G. Worthy, which is incorporated by reference herein.

TECHNICAL FIELD OF THE INVENTION

The present invention relates generally to the identification of radio stations to which radio tuners are tuned. More specifically, the present invention relates to the detection of the harmonics of survey signals, from a remote location, to identify the radio stations to which tuners are tuned.

BACKGROUND OF THE INVENTION

The commercial broadcast industry and businesses which advertise through the radio frequency (RF) broadcast media need to know the sizes of audiences which are tuned to particular stations relative to other stations at particular times. This need has been met primarily through the use of verbal or written audience participation surveys. With respect to radio, a majority of the listening occurs in automobiles. A problem with written surveys is that listeners cannot practically make a record of their listening tendencies while driving.

In order to make a record of listening tendencies while driving, passive electronic RF monitoring equipment has been used to remotely identify the stations to which tuners may be tuned. Generally speaking, audiences' radio tuners use predetermined signals, such as local oscillator signals, that are related to the frequencies of the respective stations currently being tuned in. The local oscillator signals are broadcast or otherwise emitted from the tuners as very weak signals that sensitive monitoring equipment can detect. The passive monitoring equipment identifies the radio stations to which tuners are tuned by detecting these local oscillator signals.

This remote monitoring technique is desirable because it does not require cooperation from an audience, hence reducing or eliminating a host of inaccuracies and costs associated with audience participation surveys. Furthermore, large sample sizes may be monitored at low cost relative to audience participation survey techniques.

Typically, prior art passive monitoring systems call for the local oscillator signals to be well above the level of background electronic noise in the area at which the remote monitoring is to occur. One primary source of background electronic noise, or interference, is from the radio stations themselves because the radio stations broadcast near in frequency to the desired local oscillator signal, and with much higher power.

The background electronic noise may cause local oscillator signals at some frequencies to be more readily detectable than other frequencies leading to station bias in favor of stations whose related local oscillator signals may have a lower level of background noise. One attempt to compensate for this station bias is to tune the monitoring equipment to the radio station or frequency with the lowest amount of signal to noise ratio in order to equalize the detection of the noisiest local oscillator signal with the detection of the other less noisy oscillator signals. Unfortunately, such a strategy results in the reduced sensitivity of the monitoring equipment and a reduced number of incidences that a radio station is identified, or counted, through the detection of the corresponding local oscillator signal.

In addition, other types of interference will affect the prior art passive monitoring systems. For example, interference from intermittent transmissions from radio stations, television stations, airports, and so forth may be erroneously counted by the monitoring equipment. Consequently, significant "post" data integrity checking is employed to eliminate such erroneous counts from the record. Post data integrity checking undesirably drives up the costs of the survey technique and increases the potential for creating error in the survey record.

An active electronic RF monitoring system has also been used to remotely identify the stations to which tuners may be tuned. The active system broadcasts an RF survey signal which is related to an RF carrier signal, or radio broadcast signal. The RF survey signal is configured to cause a radio tuner to emit an audio echo signal from its corresponding speaker. Simultaneously, the audio echo signal is electromagnetically radiated from the radio tuner when the tuner is tuned to the radio broadcast signal related to the RF survey signal. The active monitoring equipment identifies the radio stations to which tuners are tuned by detecting the electromagnetically radiated audio echo signal. Unfortunately, the audio echo signal may be detected by some survey participants as interference on the radio station.

SUMMARY OF THE INVENTION

Accordingly, it is an advantage of the present invention that a system and method for remotely identifying RF broadcast stations in the presence of significant background interference are provided.

It is another advantage of the present invention that the system and method identify RF broadcast stations by detecting the harmonics of survey signals.

It is another advantage of the present invention that the system and method remotely obtain audience survey data in a manner that does not interfere with the RF broadcast signals.

It is yet another advantage of the present invention that post data integrity checking is substantially reduced through the detection of the harmonics of the survey signals.

The above and other advantages of the present invention are carried out in one form by a remote audience survey method for identifying radio stations to which tuners are tuned, the tuners having predetermined signals emitted therefrom, and the predetermined signals being associated with the radio stations. The method calls for selecting one of the predetermined signals associated with one of the radio stations, the one predetermined signal exhibiting a fundamental frequency. The method further calls for receiving a second signal, detecting a harmonic of the fundamental frequency within the second signal, and determining that one of the tuners is tuned to the radio station in response to the detecting operation.

The above and other advantages of the present invention are carried out in another form by a remote audience survey system for identifying a radio station to which a tuner is tuned, the tuner having local oscillator (LO) signals emitted therefrom. The system includes a controller configured to select one of the LO signals associated with the radio station, the one LO signal exhibiting a fundamental frequency. An antenna is configured to receive a second signal. A receiver is in communication with the antenna the controller. The receiver is configured to detect a harmonic of the fundamental frequency within the second signal to determine that the tuner is tuned to the radio station.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
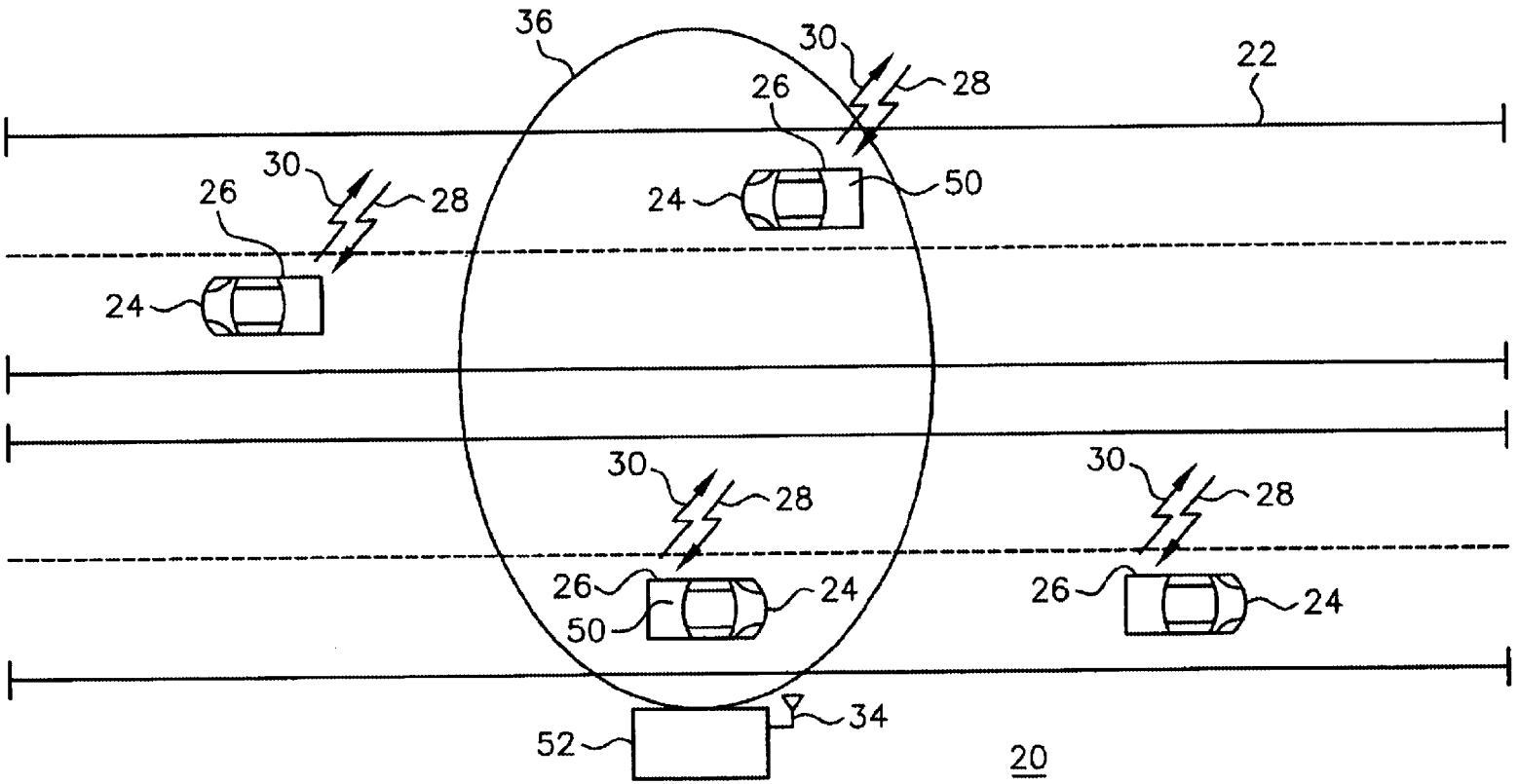
FIG. 1 shows a diagram of an example environment within which a preferred embodiment of the present invention may operate.

FIG. 1 shows a diagram of an example environment 20 within which a preferred embodiment of the present invention may operate. Environment 20 includes a road 22 on which any number of radio-equipped vehicles 24, such as cars, trucks, motorcycles, and the like, may travel in either of two directions.

Many of vehicles 24 include a radio or tuner 26 for receiving commercially broadcast radio or other signals, such as conventional AM, FM, television, and the like. For purposes of the following description, radios and tuners are synonymous including all of the components thereof, such as antennas, loudspeakers, and the like. Tuners 26 detect RF broadcast signals, or radio broadcast signals 28, through a well known demodulation process which requires tuners 26 to generate predetermined signals, such as local oscillator (LO) signals 30 related to radio broadcast signals 28 for radio stations.

The currently preferred embodiment of the present invention identifies the FM radio stations to which some of tuners 26 may be tuned by detecting the harmonics of LO signals 30 (described below). However, those skilled in the art will appreciate that many features of the present invention may be successfully applied to identifying AM, L-band, television stations, and so forth, either alone or in combination with the detection of FM stations. Moreover, the predetermined signals need not be local oscillator signals 30 generated by tuners 26, but may be any predetermined signal generated or echoed by associated elements of tuners 26, including antennas, or loudspeakers, that can be related to radio broadcast signals 28.

The present invention uses an antenna 34 to establish a detection zone 36 within which LO signals 30 emitted from vehicles 24 may be received. In exemplary environment 20, detection zone 36 extends across road 22 to cover traffic lanes for two directions. Antenna 34 may be a directional antenna with a substantially flat response through the frequency bands of interest (discussed below).

For the conventional FM band standard used in the United States and elsewhere, each of LO signals 30 oscillate at a fundamental frequency around 10.7 MHz above the frequency of radio broadcast signal 28 for a radio station to which a tuner 26 is currently tuned. In other words, since the FM band for radio broadcast signals 28 is 88.1–107.9 MHz, LO signals 30 are exhibit even tenth-MHz fundamental frequencies in the band of 98.8–118.6 MHz.

Figure 2:
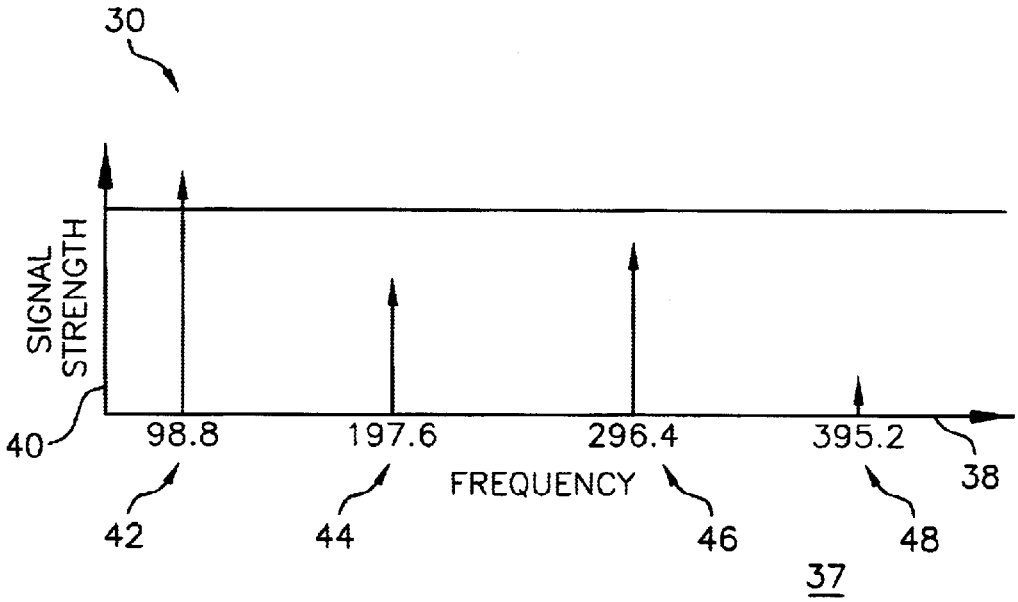
FIG. 2 shows an exemplary graph of frequency versus signal strength of a local oscillator (LO) signal.

Referring to FIG. 2 in connection with FIG. 1, FIG. 2 shows an exemplary graph 37 of frequency 38 versus signal strength 40 of one of LO signals 30. Graph 37 shows a fundamental frequency 42 for LO signal 30 as being 98.8 MHz. Fundamental frequency 42 is also known as the first harmonic of LO signal 30. A harmonic is a sinusoidal component of a complex waveform, such as LO signal 30. When tuner 26 generates LO signal 30 at fundamental frequency 42, higher order harmonics are also included within the harmonic content of LO signal 30. For example, a second harmonic 44, shown as 197.6 MHz, is twice that of fundamental frequency 42, a third harmonic 46, shown as 296.4 MHz, is thrice that of fundamental frequency 42, and a fourth harmonic 48, shown as 395.2 MHz, is four times that of fundamental frequency 42.

LO signals 30 are very weak signals which are emitted from tuners 26 primarily by a vehicle's antenna 50. Vehicle antenna 50 couples to tuner 26 and is primarily intended to receive radio broadcast signals 28. Signal strength 40 of LO signal 30 may vary significantly from vehicle 24 to vehicle 24. In addition, the background electronic noise, or interference, may be greater on LO signals 30 on some of fundamental frequencies 42 than on LO signals 30 at others of fundamental frequencies 42. The variance of signal strength 40 and the imposition of interference between LO signals 30 can result in survey errors when merely detecting LO signals 30 at fundamental frequencies 42 in a passive remote monitoring equipment.

The present invention mitigates the problems associated with detecting LO signals 30 by additionally or alternatively detecting the presence of second and/or third harmonics 44 and 46, respectively, of fundamental frequencies 42 of LO signals 30 to identify radio stations to which tuners 26 are tuned.

Figure 3:
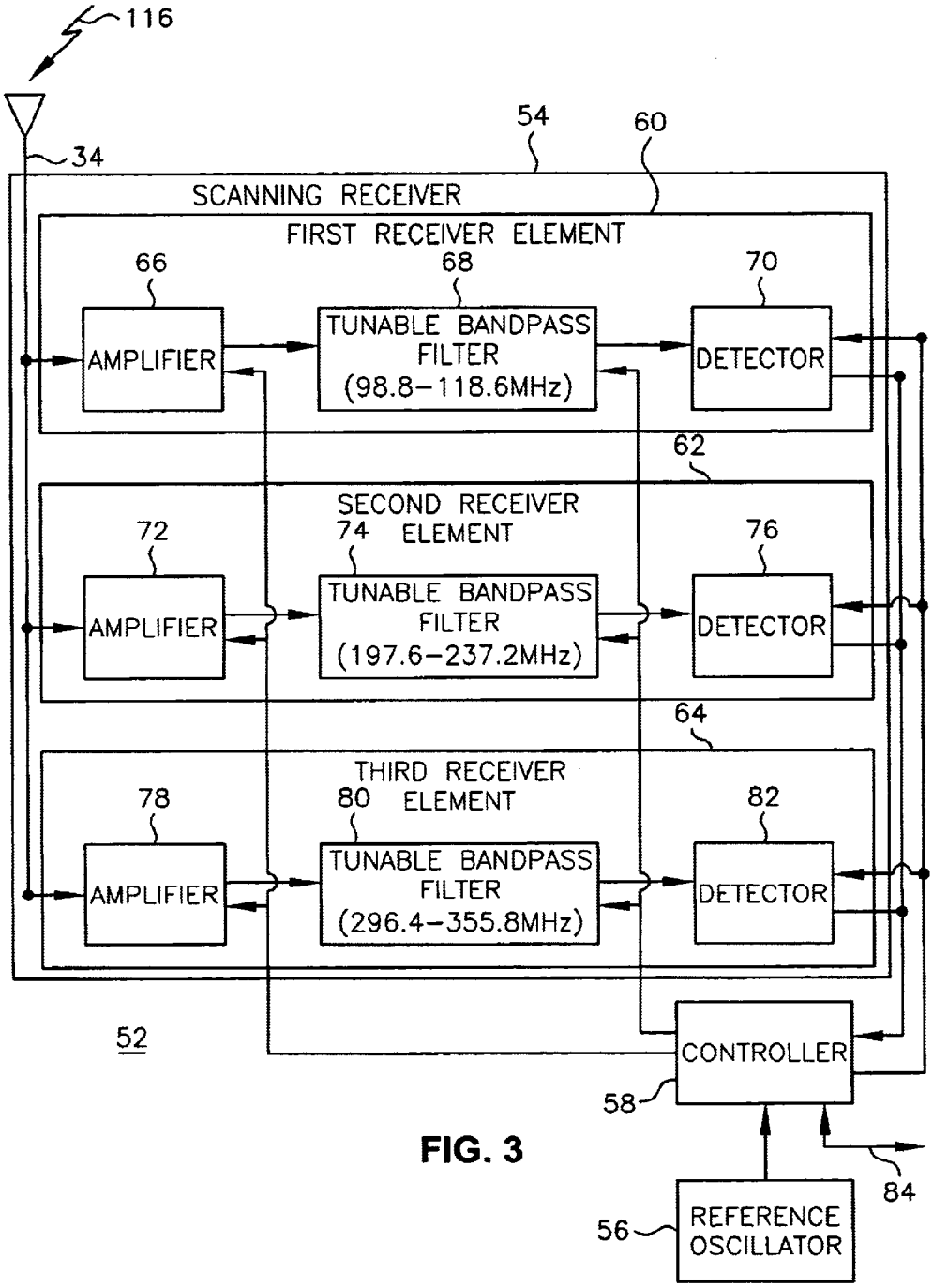
FIG. 3 shows a block diagram of a passive survey electronics system.

FIG. 3 shows a block diagram of a passive survey electronics system 52. System 52 includes antenna 34, discussed above, a scanning receiver 54, a reference oscillator 56, and a controller 58 in data communication with each of receiver 54 and reference oscillator 56.

Scanning receiver 54 includes a first receiver element 60, a second receiver element 62, and a third receiver element 64. Antenna 34 is in communication with a signal input of an amplifier 66 of first receiver element 60. An output of amplifier 66 couples to a signal input of a tunable bandpass filter 68, and an output of filter 68 couples to a signal input of a detector 70. A signal output of detector 70 couples to an input of controller 58. Tunable bandpass filter 68 has an RF-range center frequency specified by controller 58 and is configured to be tuned to receive fundamental frequencies 42 of LO signals 30 (FIG. 1) within the band of 98.8–118.6 MHz.

Likewise, antenna 34 is in communication with a signal input of an amplifier 72 of second receiver element 62. An output of amplifier 72 couples to a signal input of a tunable bandpass filter 74, and an output of filter 74 couples to a signal input of a detector 76. A signal output of detector 76 couples to an input of controller 58. Tunable bandpass filter 74 has an RF-range center frequency specified by controller 58 and is configured to be tuned to receive second harmonics 44 of LO signals 30 (FIG. 1) within the band of 197.6–237.2 MHz.

Antenna 34 is also in communication with a signal input of an amplifier 78 of third receiver element 64. An output of amplifier 78 couples to a signal input of a tunable bandpass filter 80, and an output of filter 80 couples to a signal input of a detector 82. A signal output of detector 82 couples to an input of controller 58. Tunable bandpass filter 80 has an RF-range center frequency specified by controller 58 and is configured to be tuned to receive third harmonics 46 of LO signals 30 (FIG. 1) within the band of 296.4–355.8 MHz.

In a preferred embodiment, scanning receiver 54 is a digital receiver in which tuning parameters are individually set for each frequency in a frequency band of interest. For example, for each of LO signals 30. (FIG. 1) at a particular location of system 52 (see FIG. 1), the On/Off status of each of first, second, and third receiver elements 60, 62, and 64 may be set depending upon whether or not fundamental frequency 42 (FIG. 2), second harmonic 44 (FIG. 2), or third harmonic 46 (FIG. 2) of one of LO signals 30 is expected to be detectable through the background interference in detection zone 36. This On/Off status provides the benefit of lower current draw, and yet system 52 still retains the capability of receiving all three of fundamental frequency 42, second harmonic 44, and third harmonic 46 as desired. Depending on how many of first, second, and third receiver elements 60, 62, and 64 are powered at one time determines current draw of system 52 and the speed at which all frequencies are scanned.

In addition, the digital receiver implementation allows first, second, and third receiver elements 60, 62, and 64 to operate in parallel so as to concurrently receive LO signals 30 and concurrently detect fundamental frequency 42, second harmonic 44, and third harmonic 46. This parallel operation increases the scanning speed and ultimately the number of survey records created.

Furthermore, the digital implementation of scanning receiver 54, allows the gain of each of amplifiers 66, 72, and 78, and the bandwidth of each of filters 68, 74, and 80, to be individually set to insure that the expected ones of fundamental frequency 42 (FIG. 2), second harmonic 44, and third harmonic 46 to which scanning receiver 54 can be tuned will be received equally with respect to each other.

Each of first, second, and third receiver elements 60, 62, and 64 can be further tuned to scan or track together. For example, if first receiver element 60 is tuned to receive fundamental frequency 42 of 98.8 MHz, then second receiver element 62 will be tuned to receive second harmonic 44 of 197.6 MHz, and third receiver element 64 will be tuned to receive third harmonic 46 of 296.4 MHz.

Since first, second, and third receiver elements 60, 62, and 64 track all of fundamental frequency 42, second harmonic 44, and third harmonic 46 of LO signals 30, a signal found on one may be checked with the other two. In addition, system 52 advantageously has the ability to receive each of second and third harmonics 44 and 46, respectively, because tuners 26 (FIG. 1) tend to emit LO signals 30 (FIG. 1) rich in either even (i.e., second harmonic 44) or odd (i.e., third harmonic 46) harmonics, but not both. In contrast, generally interference and broadcast signals do not have significant harmonic content.

Each of detectors 70, 76, and 82 of first, second, and third receiver elements 60, 62, and 64, respectively, amplifies and rectifies its corresponding input signal. In addition, each of detectors 70, 76, and 82 compares the resulting input signal to a threshold value or some detection criterion supplied by controller 58 to determine if one of tuners 26 (FIG. 2) is tuned a radio station corresponding to one of radio broadcast signals 28 (FIG. 1).

Reference oscillator 56 provides a stable frequency reference. In the embodiment shown in FIG. 3, oscillator 56 or a signal derived from oscillator 56 serves as a clock signal for controller 58. Controller 58 may be implemented using conventional microprocessor and microcontroller circuits and related peripherals well known to those skilled in the art. Such circuits and peripherals include non-volatile and volatile memory (not shown) within which a computer program is stored and within which variables, tables, lists, and databases manipulated by the computer program are stored. A communications port 84 of controller 58 provides a way to enter and extract data from controller 58. Port 84 may be provided by a disk drive, modem, cellular or land-line communications link, and the like.

Figure 4A:
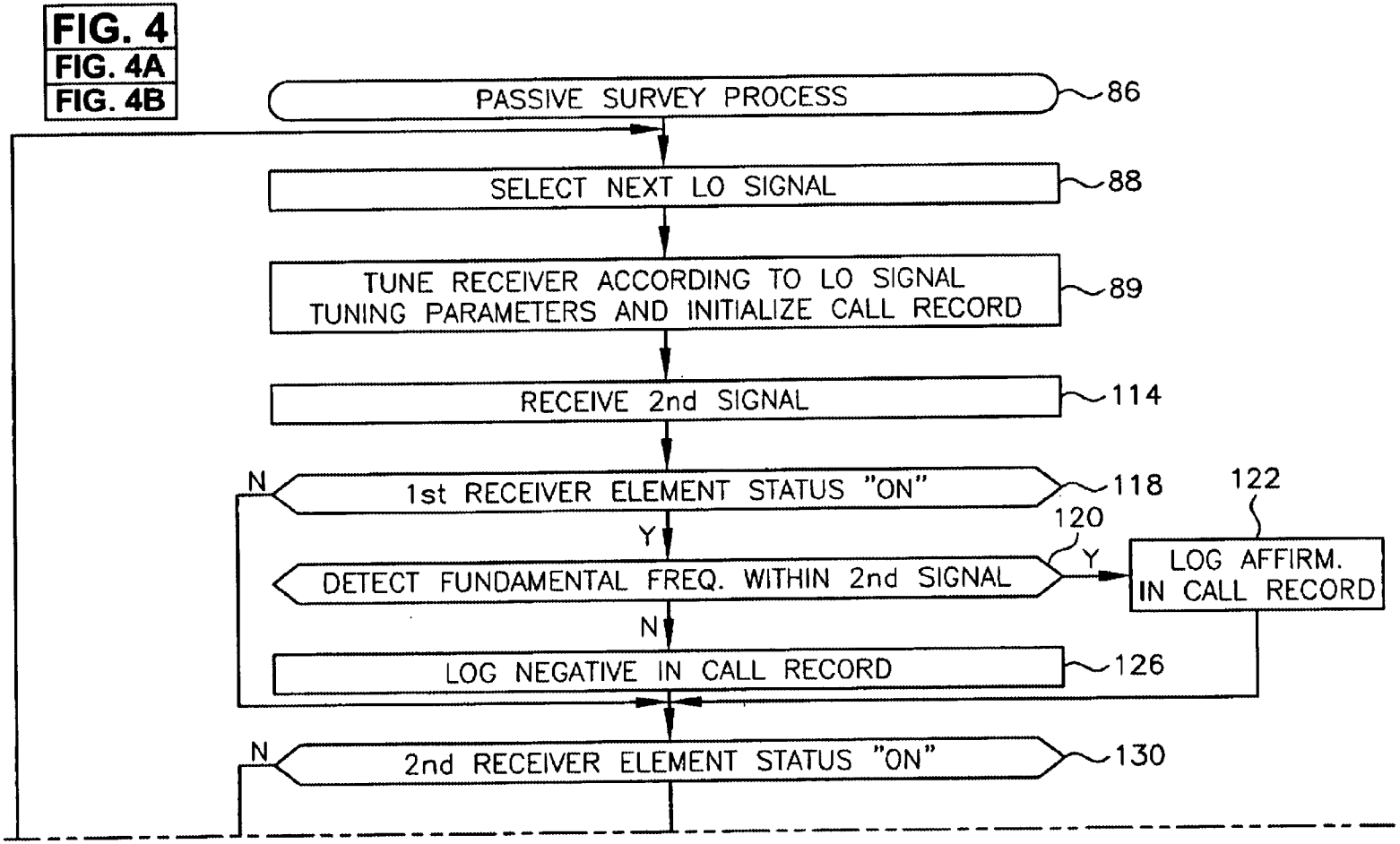
FIG. 4 shows a flow chart of a passive survey process performed by the passive survey electronics system of FIG. 3.
Figure 4B:
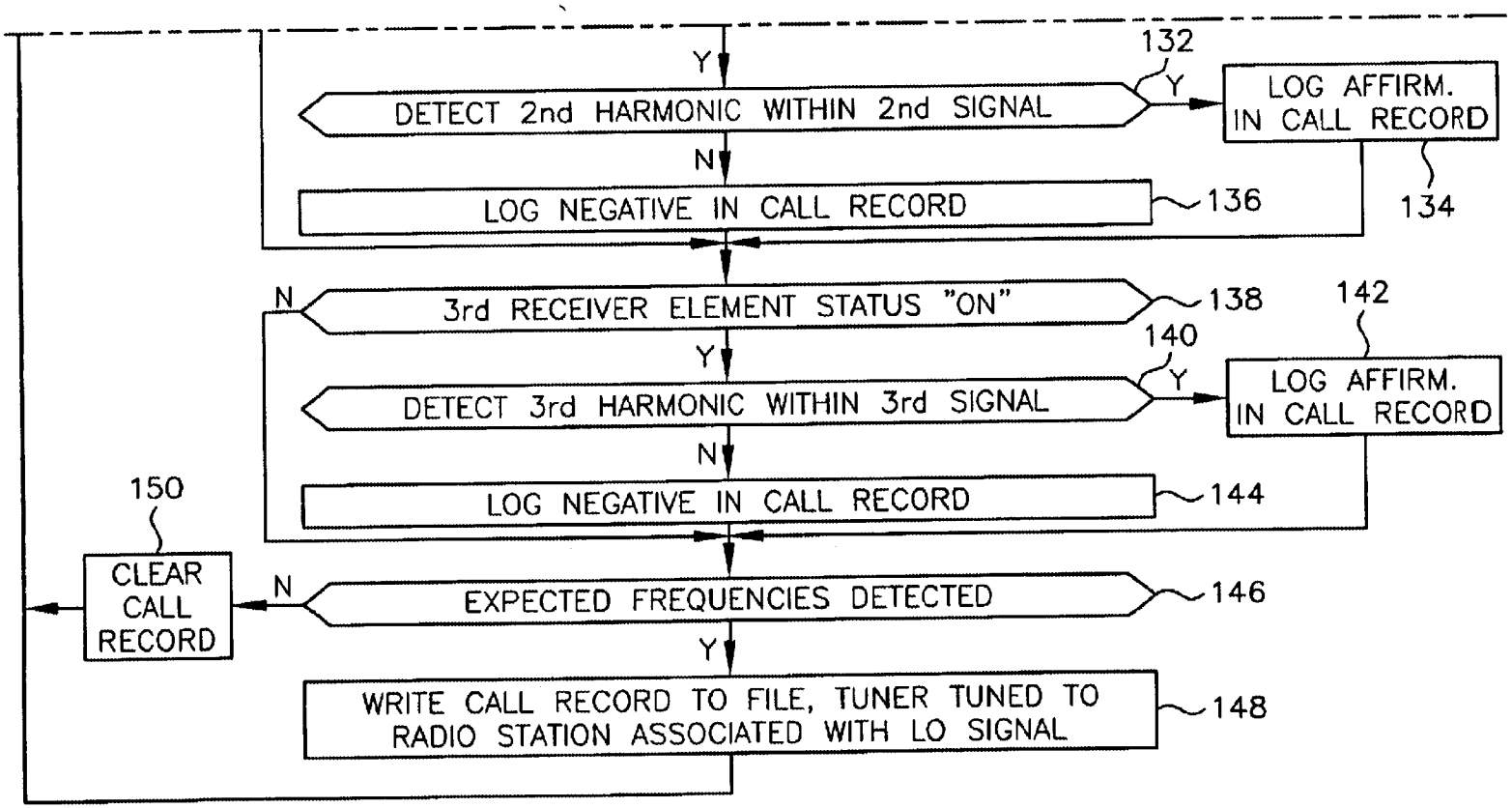

FIG. 4 shows a flow chart of a passive survey process 86 performed by passive survey electronics system 52 (FIG. 3). Process 86 is defined by a computer program stored in and executed by controller 58 (FIG. 3). Generally, process 86 operates continuously in a loop to obtain data which are then communicated through port 84 (FIG. 3) and further processed in a conventional manner to form an audience survey.

Figure 5:
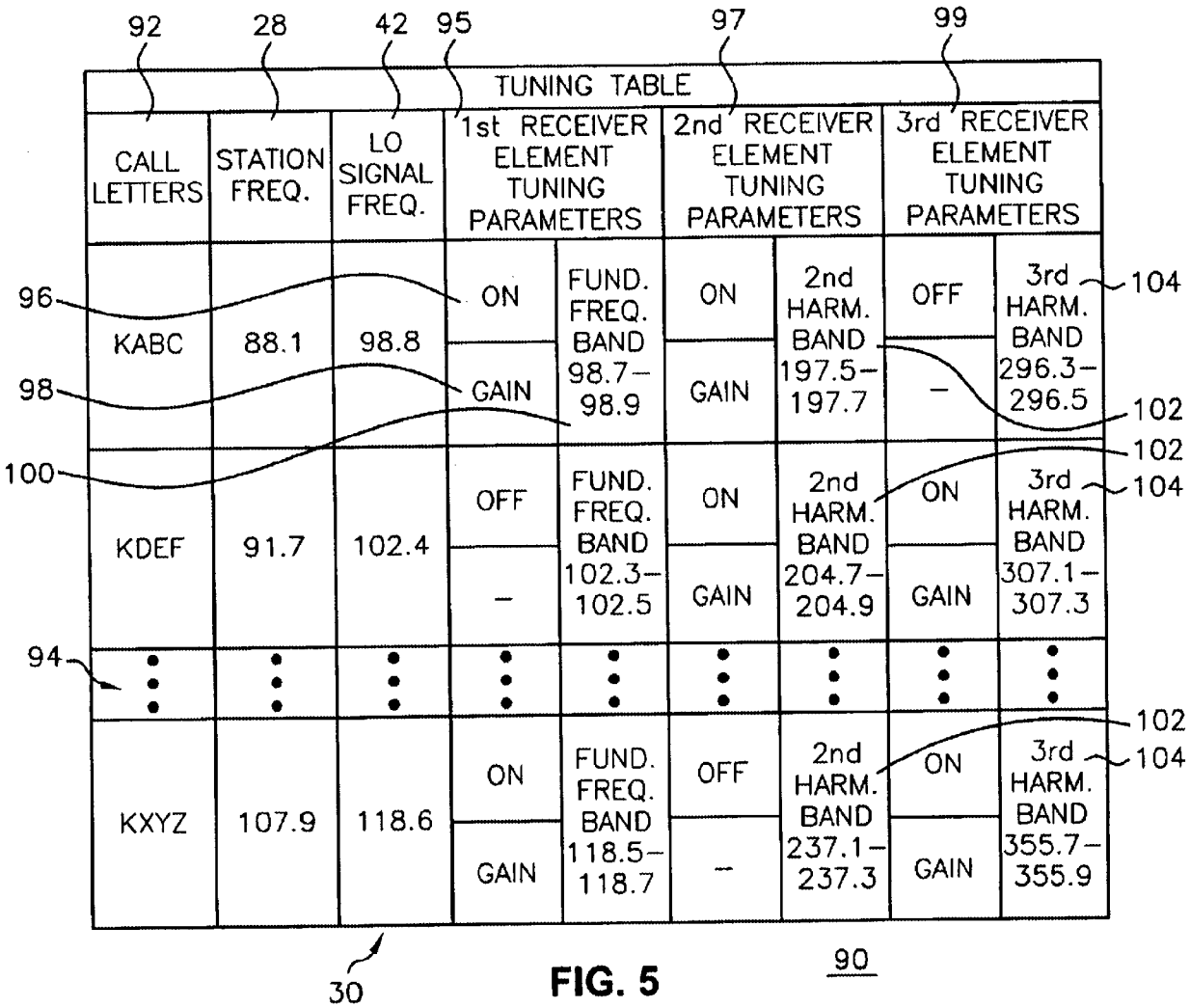
FIG. 5 shows a tuning table maintained in a memory structure within a controller portion of the passive survey electronics system of FIG. 3.

Process 86 begins with a task 88 which selects a next local oscillator signal 30. The selected LO signal 30, as described in connection with process 86 is a survey signal. Task 88 may consult a table when selecting a next LO signal 30. Referring to FIG. 5 in connection with task 88, FIG. 5 shows a tuning table 90 which is maintained in a memory structure (not shown) within controller 58 (FIG. 3) of system 52 (FIG. 3).

Table 90 depicts an exemplary memory structure which associates radio stations 92, identified by their call letters, with their related radio broadcast signals 28 and LO signals 30. For clarity of illustration, LO signals 30 are identified in table 90 by their related fundamental frequencies 42.

Tuning table 90 may include any number of radio stations 92, as indicated by ellipsis 94. However, table 90 is constructed to include only LO signals 30 corresponding to radio stations 92 which are to be included in an audience survey prepared by system 52 (FIG. 3). Typically, all radio stations 92 whose LO signals 30 are reasonably detectable at any of fundamental frequency 42, second harmonic 44, or third harmonic 46 in detection zone 36 (FIG. 1) are included in an audience survey. Any radio stations 92 not reasonably detectable in zone 36 are omitted from table 90 and the audience survey, and desirably none of radio stations 92 are listed twice in table 90.

With reference to FIGS. 4 and 5, task 88 may move a pointer (not shown) to a next entry in table 90 to select the next one of LO signals 30. Thus, the next one of LO signals 30 selected is the next one of fundamental frequencies 42 listed in table 90. Of course when the pointer reaches the end of table 90 it may return to the beginning of table 90.

A task 89 is performed in connection with task 88. Task 89 tunes first, second, and third receiver elements 60, 62, and 64 (FIG. 3) of scanning receiver 54 according to tuning parameters associated with the selected one of LO signals 30. As shown in FIG. 5, tuning table 90 includes tuning parameters for each of first, second, and third receiver elements 60, 62, and 64, in association with each of LO signal fundamental frequencies 42.

The tuning parameters represent data that serve as instructions for the control of receiver elements 60, 62, and 64 by controller 58 (FIG. 3). For example, tuning parameters 95 for first receiver element 60 include an On/Off status 96, an amplifier gain value 98, and a fundamental frequency band 100. Likewise, tuning parameters 97 for second receiver element 62 include On/Off status 96, amplifier gain value 98, and a second harmonic frequency band 102. In addition, tuning parameters 99 for third receiver element 64 include On/Off status 96, amplifier gain value 98, and a third harmonic frequency band 104. The tuning parameters of tuning table 90 are desirably set for detection zone 36 (FIG. 1) when system 52 (FIG. 3) is positioned along road 22 (FIG. 1).

Figure 6:
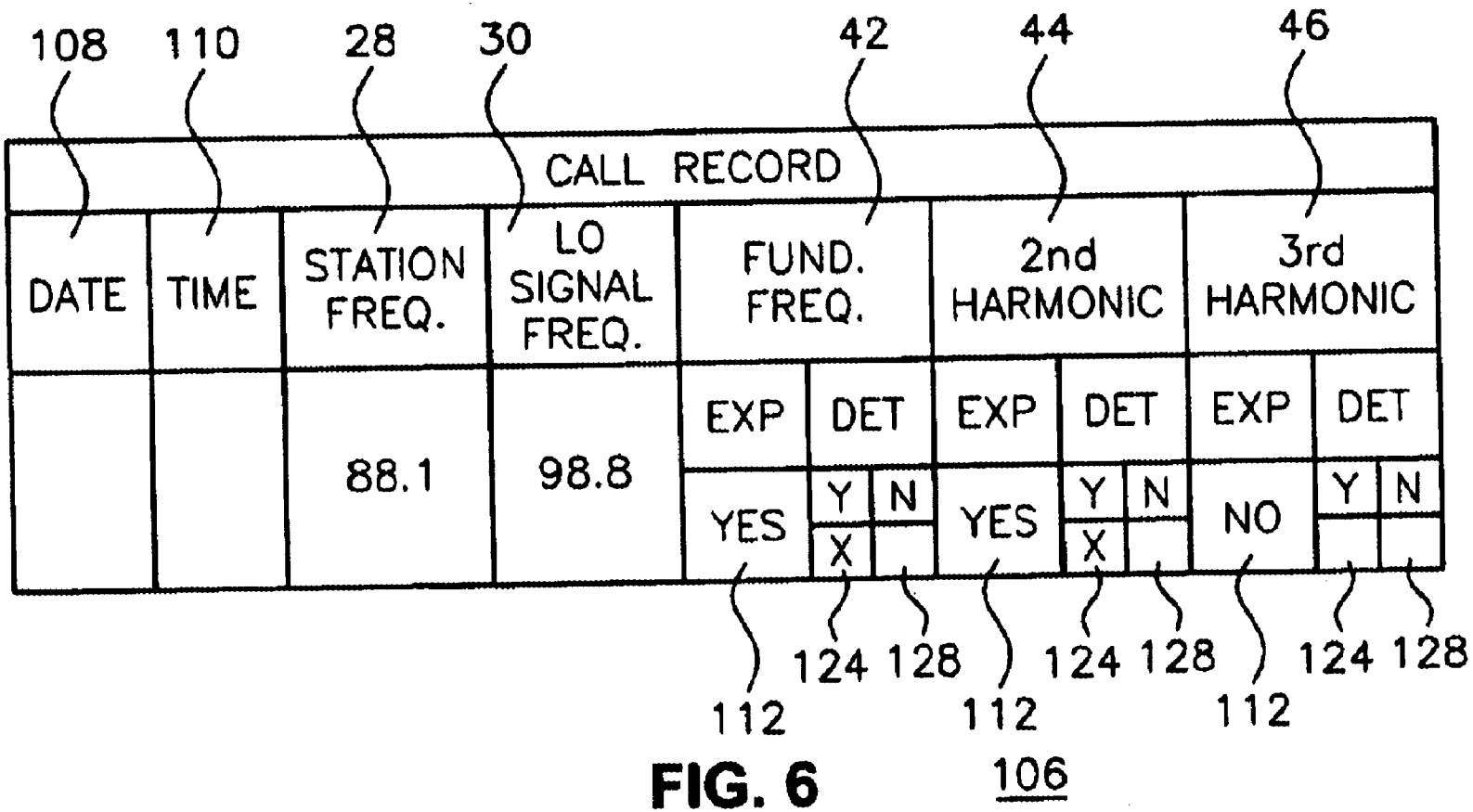
FIG. 6 shows an exemplary format for a call record logged by the controller portion of the passive survey electronics system of FIG. 3.

In addition to tuning scanning receiver 54, task 89 initializes a "call", or survey, record for the selected one of LO signals 30. FIG. 6 shows an exemplary format for a call record 106 initialized by controller 58 (FIG. 3) of system 52 (FIG. 3) through the execution of task 89. Call, or survey, record 106, includes data relevant to the detection of one of radio stations 92 (FIG. 5) to which one of tuners 26 (FIG. 1) may be tuned. Task 89 may, for example, record a date 108 and start time 110 for the detection of fundamental frequency 42, or its second or third harmonic 44 or 46, respectively, of the selected one of LO signals 30 related to one of radio broadcast signals 28.

Call record 106 also includes expected signal fields 112 for each of fundamental frequency 42, second harmonic 44, and third harmonic 46. Field 112 is completed in response to On/Off status 96 from tuning table 90 (FIG. 5). For example, in accordance with On/Off status 96 of tuning table 90, first and second receiver elements 60 and 62, respectively are "ON" and third receiver element 64 is "OFF". This corresponds to the expectation that fundamental frequency 42 and second harmonic 44 for the selected one of LO signals 30 will be detectable, and third harmonic 46 will not be detectable. As such, task 89 initializes fields 112 for fundamental frequency 42 and second harmonic 44 with "YES" and field 112 for third harmonic 46 with "NO".

Call record 106 will be completed through the further execution of process 86 (FIG. 4) and saved in a memory structure (not shown) of controller 58 (FIG. 3) if one of tuners 26 is tuned to one of radio stations 92 associated with the selected one of LO signals 30. If one of tuners 26 is not detected, call record 106 will not be completed.

Referring back to process 86 (FIG. 4), following tuning and initialization task 89, a task 114 is performed. Task 114 causes system 52 to be enabled to receive a second signal 116 (see FIG. 3). Task 114 may set a timer (not shown) for monitoring a duration of time during which the selected one of LO signals 30 is to be detected and evaluated for fundamental frequency 42, second harmonic 44, and third harmonic 46.

In response to task 114, a query task 118 is performed. Query task 118 determines if On/Off Status 96 (FIG. 5) for first receiver element 60 (FIG. 3) is "On". When query task 118 determines On/Off Status 96 is "On", process 86 proceeds to a query task 120. Query task 120 determines if fundamental frequency 42 (FIG. 2) for the selected one of LO signals 30 (FIG. 1) is detected within second signal 116 (FIG. 3).

In making this determination, query task 120 may desirably evaluate a signal strength parameter to insure that the received second signal 116 exhibits an amplitude at fundamental frequency 42 above a predetermined minimum to reduce the likelihood of confusing a spurious signal with a legitimate call. When query task 120 determines that fundamental frequency 42 is detected, program control proceeds to a task 122.

At task 122, an affirmative response is logged into an affirmative response field 124 (FIG. 6) of call record 106 (FIG. 6) for fundamental frequency 42. However, when query task 120 determines that fundamental frequency 42 is not detected within second signal 116, program control proceeds to a task 126. At task 126, a negative response is logged into a negative response field 128 (FIG. 6) of call record 106 (FIG. 6) for fundamental frequency 42.

Referring back to query task 118, when query task 118 determines that On/Off Status 96 (FIG. 5) for first receiver element 60 (FIG. 3) is not "On", process 86 proceeds to a query task 130. Likewise, following tasks 122 and 126, process 86 proceeds to query task 130.

Query task 130 determines if On/Off Status 96 (FIG. 5) for second receiver element 62 (FIG. 3) is "On". When query task 130 determines On/Off Status 96 is "On", process 86 proceeds to a query task 132. Query task 132 determines if second harmonic 44 (FIG. 2) for the selected one of LO signals 30 (FIG. 1) is detected within second signal 116 (FIG. 3).

In making this determination, query task 132 may desirably evaluate a signal strength parameter to insure that received second signal 116 exhibits an amplitude at second harmonic 44 above a predetermined minimum to reduce the likelihood of confusing a spurious signal with a legitimate call. This predetermined minimum amplitude need not be the same amplitude as that used by query task 120, but may be optimized for the detection of second harmonic 44. When query task 132 determines that second harmonic 44 is detected, program control proceeds to a task 134.

At task 134, an affirmative response is logged into affirmative response field 124 (FIG. 6) of call record 106 (FIG. 6) for second harmonic 44. However, when query task 132 determines that second harmonic 44 is not detected, program control proceeds to a task 136. At task 136, a negative response is logged into negative response field 128 (FIG. 6) of call record 106 (FIG. 6) for second harmonic 44.

Referring back to query task 130, when query task 130 determines that On/Off Status 96 (FIG. 5) for second receiver element 62 (FIG. 3) is not "On", process 86 proceeds to a query task 138. Likewise, following tasks 134 and 136, process 86 proceeds to query task 138.

Query task 138 determines if On/Off Status 96 (FIG. 5) for third receiver element 64 (FIG. 3) is "On". When query task 138 determines On/Off Status 96 is "On", process 86 proceeds to a query task 140. Query task 140 determines if third harmonic 46 (FIG. 2) for the selected one of LO signals 30 (FIG. 1) is detected within second signal 116 (FIG. 3).

In making this determination, query task 140 may desirably evaluate a signal strength parameter to insure that received second signal 116 exhibits an amplitude at third harmonic 46 above a predetermined minimum to reduce the likelihood of confusing a spurious signal with a legitimate call. This predetermined minimum amplitude need not be the same amplitude as that used by query tasks 120 or 132, but may be optimized for the detection of third harmonic 46. When query task 140 determines that third harmonic 46 is detected, program control proceeds to a task 142.

At task 142, an affirmative response is logged into affirmative response field 124 (FIG. 6) of call record 106 (FIG. 6) for third harmonic 46. However, when query task 140 determines that third harmonic 46 is not detected, program control proceeds to a task 144. At task 144, a negative response is logged into negative response field 128 (FIG. 6) of call record 106 (FIG. 6) for third harmonic 46.

Referring back to query task 138, when query task 138 determines that On/Off Status 96 (FIG. 5) for third receiver element 64 (FIG. 3) is not "On", process 86 proceeds to a query task 146. Likewise, following tasks 142 and 144, process 86 proceeds to query task 146.

Query tasks 120, 132, and 140 and their ensuing actions serve the function of evaluating a signal, in the form of second signal 116, received at antenna 34 (FIG. 3) to determine if second signal 116 is the selected one of LO signals 30 oscillating at and identifiable by the detection of fundamental frequency 42, second harmonic 44, or third harmonic 46. In addition, as discussed previously, first, second, and third receiver elements 60, 62, and 64 (FIG. 3) may operate in parallel, so that query tasks 120, 132, and 140 are performed substantially concurrently so as to quickly and efficiently detect fundamental frequency 42, second harmonic 44, and third harmonic 46.

Query task 146 determines if the expected ones of fundamental frequency 42, second harmonic 44, or third harmonic 46 were detected within second signal 116. Controller 58 (FIG. 3) performs query task 146 by evaluating call record 106 (FIG. 6). Call record 106 is evaluated to determine that an affirmative response "X" is present in affirmative response field 124 for those of fundamental frequency 42, second harmonic 44, and third harmonic 46 whose corresponding expected signal field 112 contains a "Yes".

When the expected ones of fundamental frequency 42, second harmonic 44, and third harmonic 46 are detected, process 86 proceeds to a task 148. Task 148 writes call record 106 (FIG. 6), initialized in task 89, to memory so that it may later be communicated to a processing center (not shown) for compilation into a survey results report. In other words, task 148 records the detection of one of tuners 26 (FIG. 1) tuned to one of the surveyed radio broadcast signals 28 (FIG. 1) through the detection of fundamental frequency 42, second harmonic 44, and third harmonic 46 for an associated one of LO signals 30. Task 148 may also add data describing a stop time, signal strength, and other factors to call record 106.

Following task 148, program control loops back to task 88 to repeat process 86 for a selected next one of LO signals 30. In a preferred embodiment, each selected one of LO signals 30 may be evaluated in less than a few milliseconds. Accordingly, all of LO signals 30 listed in table 90 may be evaluated in less time than a vehicle 24 (FIG. 1) spends in detection zone 36 (FIG. 1)

When query task 146 determines that the expected ones of fundamental frequency 42, second harmonic 44, and third harmonic 46 are not detected, process 86 proceeds to a task 150. Task 150 clears call record 106, initialized in task 89, and program control loops back to task 88 to repeat process 86 for a selected next one of LO signals 30. In other words, no tuners 26 in detection zone 36 (FIG. 1) are tuned to the one of radio broadcast signals 28 (FIG. 1) associated with the selected one of LO signals 30.

Figure 7:
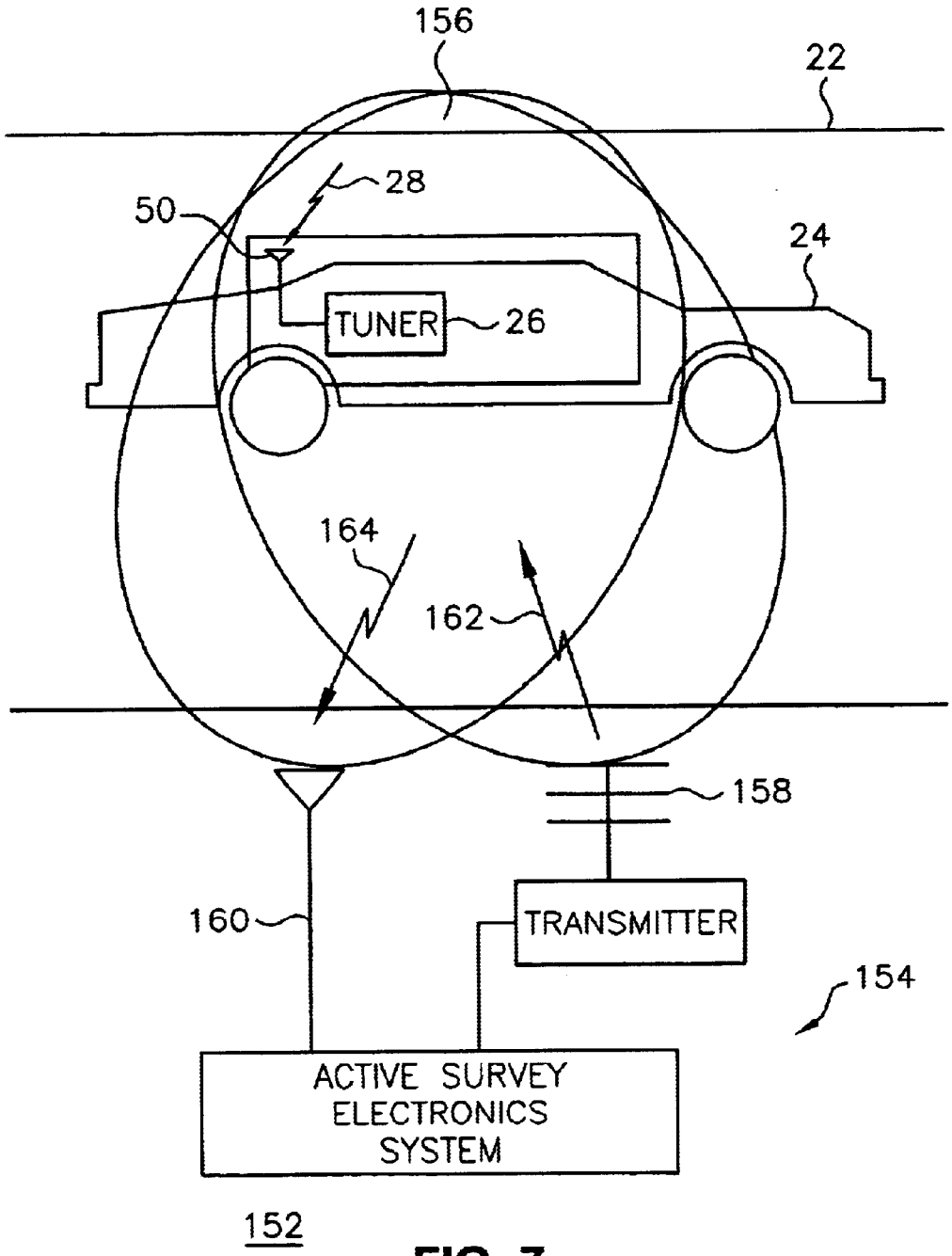
FIG. 7 shows a diagram of an example environment within which an alternative embodiment of the present invention may operate.

FIG. 7 shows a diagram of an example environment 152 within which an active survey electronics system 154 may operate in an alternative embodiment of the present invention. Generally, system 154 surveys tuners 26 mounted in vehicles 24 and traveling along road 22, only one of which is shown in FIG. 7. Tuners 26 pass through a detection zone 156, and system 154 identifies radio broadcast signals 28 to which tuners 26 are tuned, radio broadcast signals 28 being received by antennas 50 coupled to tuners 26 at the instants they pass through detection zone 156. Records of such detections are then processed in a conventional manner to generate audience survey results.

Antennas 158 and 160 have antenna patterns that overlap to define detection zone 156. Antennas 158 and 160 can be located above, beside, or on a median within road 22. Antennas 158 and 160 each couple to an active survey electronics system 154. Antenna 158 is used in a signal-transmitting role so a survey signal 162 broadcast from antenna 158 is targeted to detection zone 156. Antenna 160 is used in a signal-receiving role to detect a second signal 164 radiated from within detection zone 156.

Antenna 158 transmits survey signal 162 which is related to one of radio broadcast signals 28 of a radio station about which an audience survey is being taken. In a preferred embodiment, survey signal 162 is one of LO signals 30 (FIG. 2) oscillating at a fundamental frequency 42 (FIG. 2) which has been modified to include a signal identifier (discussed below). Antenna 50 receives survey signal 162 and tuner 26 processes survey signal 162. Accordingly, when tuner 26 is tuned to one of radio broadcast signals 28 that is related to fundamental frequency 42 of survey signal 162, survey signal 162 including the signal identifier mixes with the LO signal 30 emitted from tuner 26 in response to receiving radio broadcast signal 28 to form second signal 164. Accordingly, second signal 164 which includes the signal identifier is detected at second antenna 160 to determine that tuner 26 is tuned to one of radio broadcast signals 28. No such second signal 164, including the signal identifier, is radiated from tuner 26 when tuner 26 is not tuned to the one of radio broadcast signals 28 related to survey signal 162.

Figure 8A:
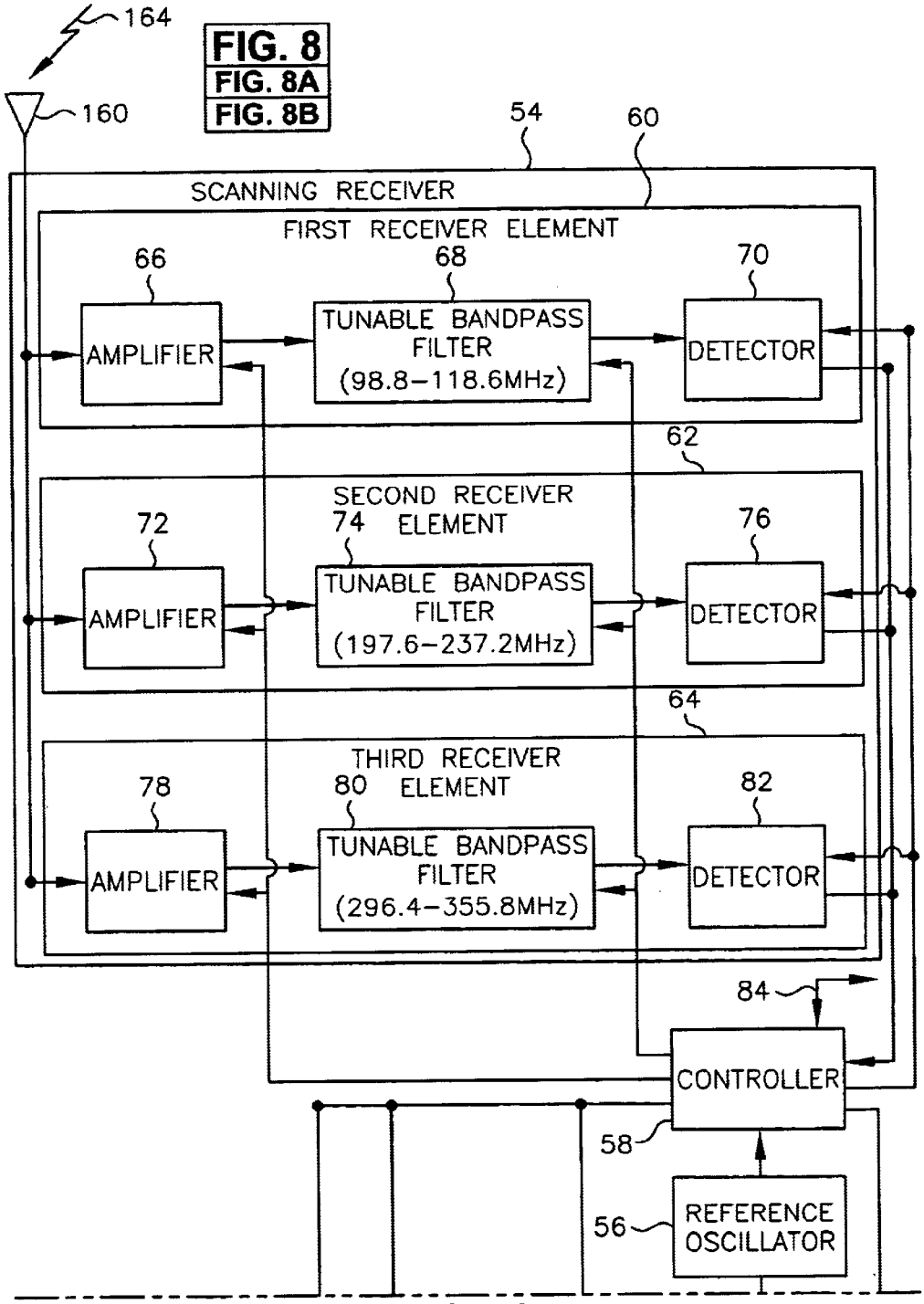
FIG. 8 shows a block diagram of an active survey electronics system in accordance with the alternative embodiment of the present invention.
Figure 8B:
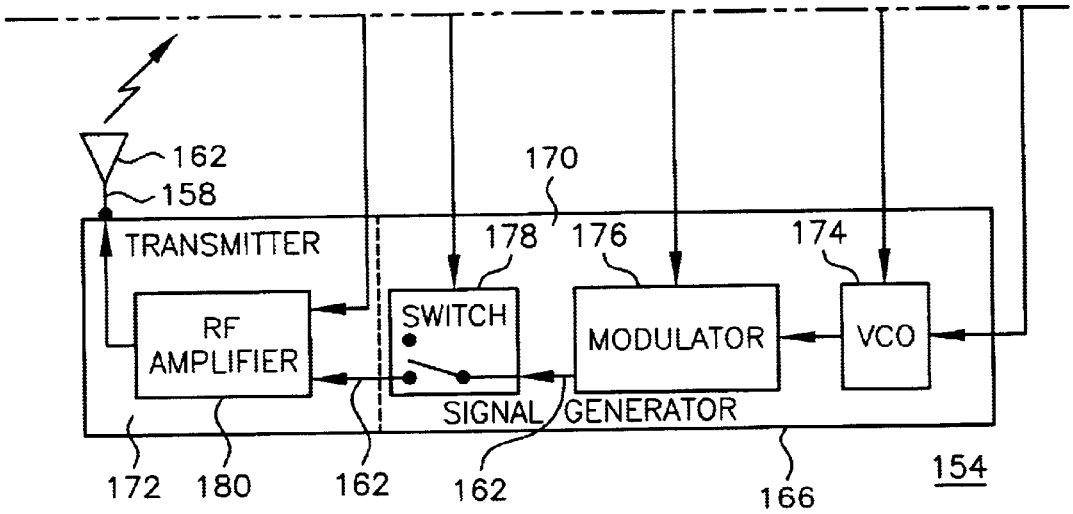

FIG. 8 shows a block diagram of active survey electronics system 154 in accordance with the alternative embodiment of the present invention. For convenience, FIG. 8 depicts antenna 158 as being a part of a transmitter 166. Likewise, FIG. 8 depicts antenna 160 as being part of scanning receiver 54, described in detail in connection with system 52 of FIG. 3. Like scanning receiver 54 and reference oscillator 56, transmitter 166 couples to controller 58.

Transmitter 166 includes a signal generator portion 170 and a transmitter portion 172. Reference oscillator 56 is additionally coupled to a voltage controller oscillator (VCO) 174 of signal generator portion 170. An output of VCO 174 couples to an input of a modulator 176 and an output of modulator 176 couples to an input of a switch 178. An output of switch 178 couples to an input of an RF amplifier 180 of transmitter portion 172, and an output of RF amplifier 180 couples to transmitting antenna 158. A control output from controller 58 is in communication with each of VCO 174, modulator 176, switch 178, and RF amplifier 180.

Figures 9, 9A, 9B:
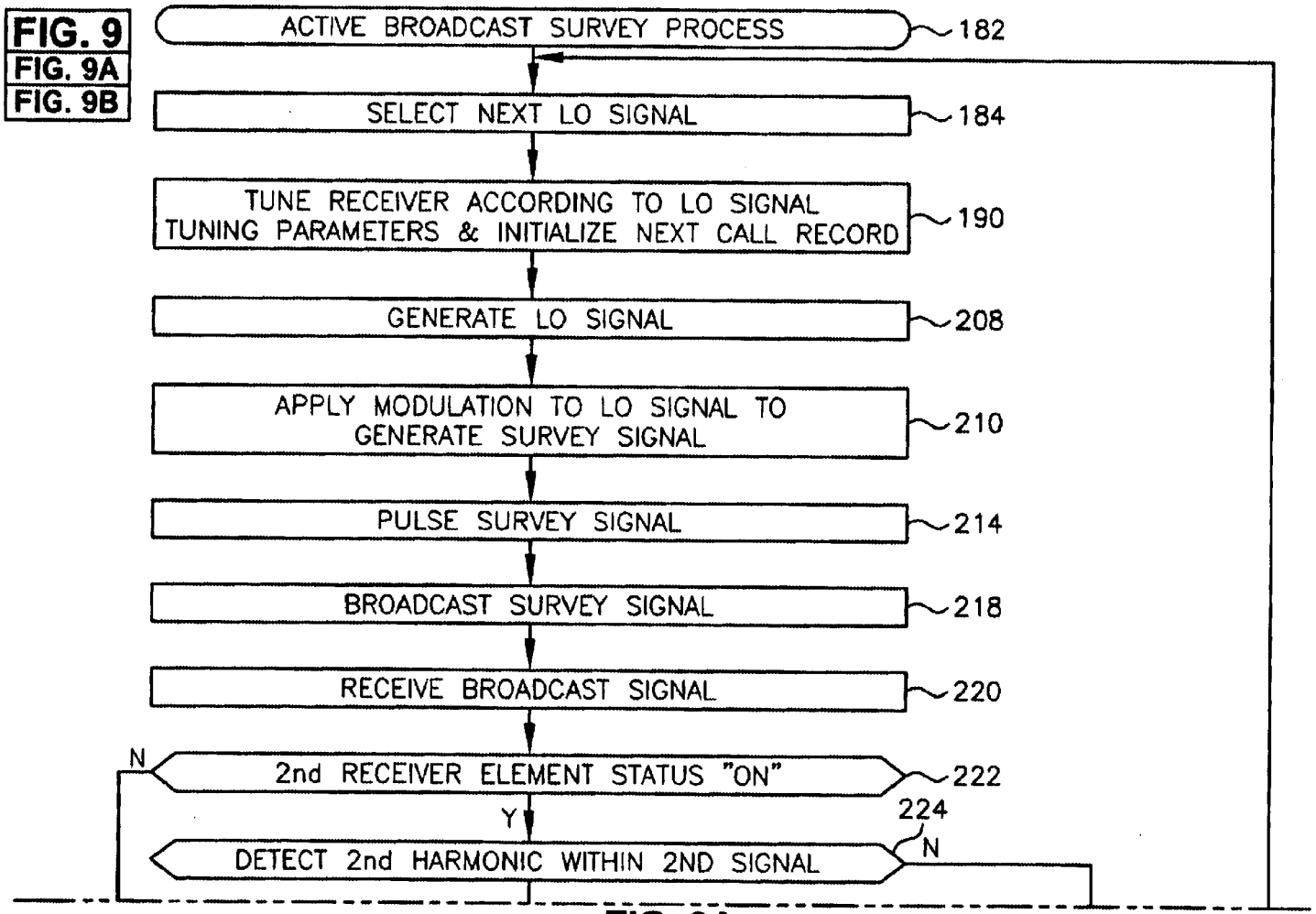
FIG. 9 shows a flow chart of an active broadcast survey process performed by the active survey electronics system of FIG. 8.
Figure 9B:
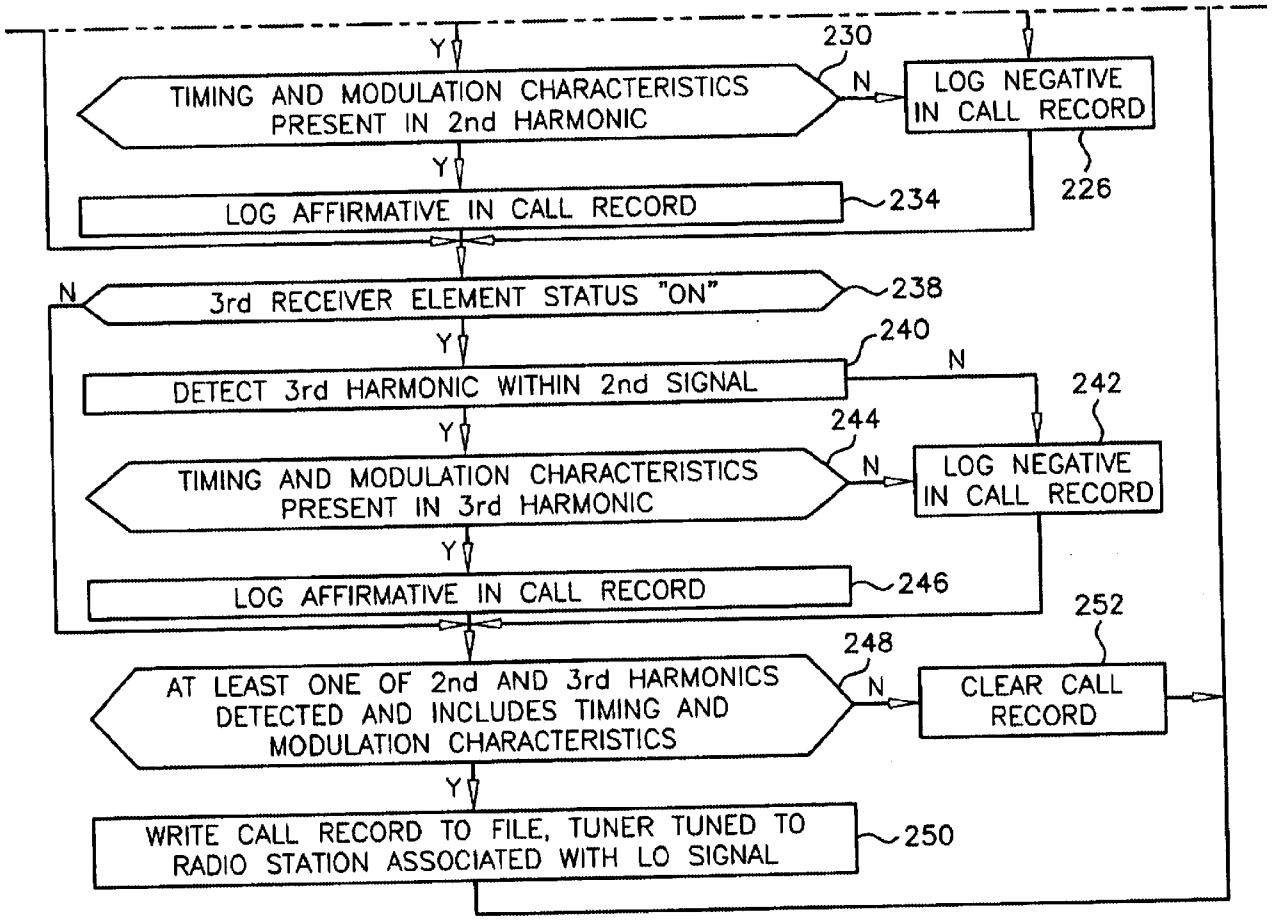

FIG. 9 shows a flow chart of an active broadcast survey process 182 performed by active survey electronics system 154 (FIG. 8). Process 182 is executed to identify radio stations to which tuners 26 are tuned by evaluating second and third harmonics 44 and 46 within second signal 164 (FIG. 7) of a selected one of LO signals 30, rather than fundamental frequency 42. Process 182 is defined by a computer program stored in and executed by controller 58 (FIG. 8). Generally, process 182 operates continuously in a loop to obtain data which are then communicated through port 84 (FIG. 8) and further processed in a conventional manner to form an audience survey.

Figure 10:
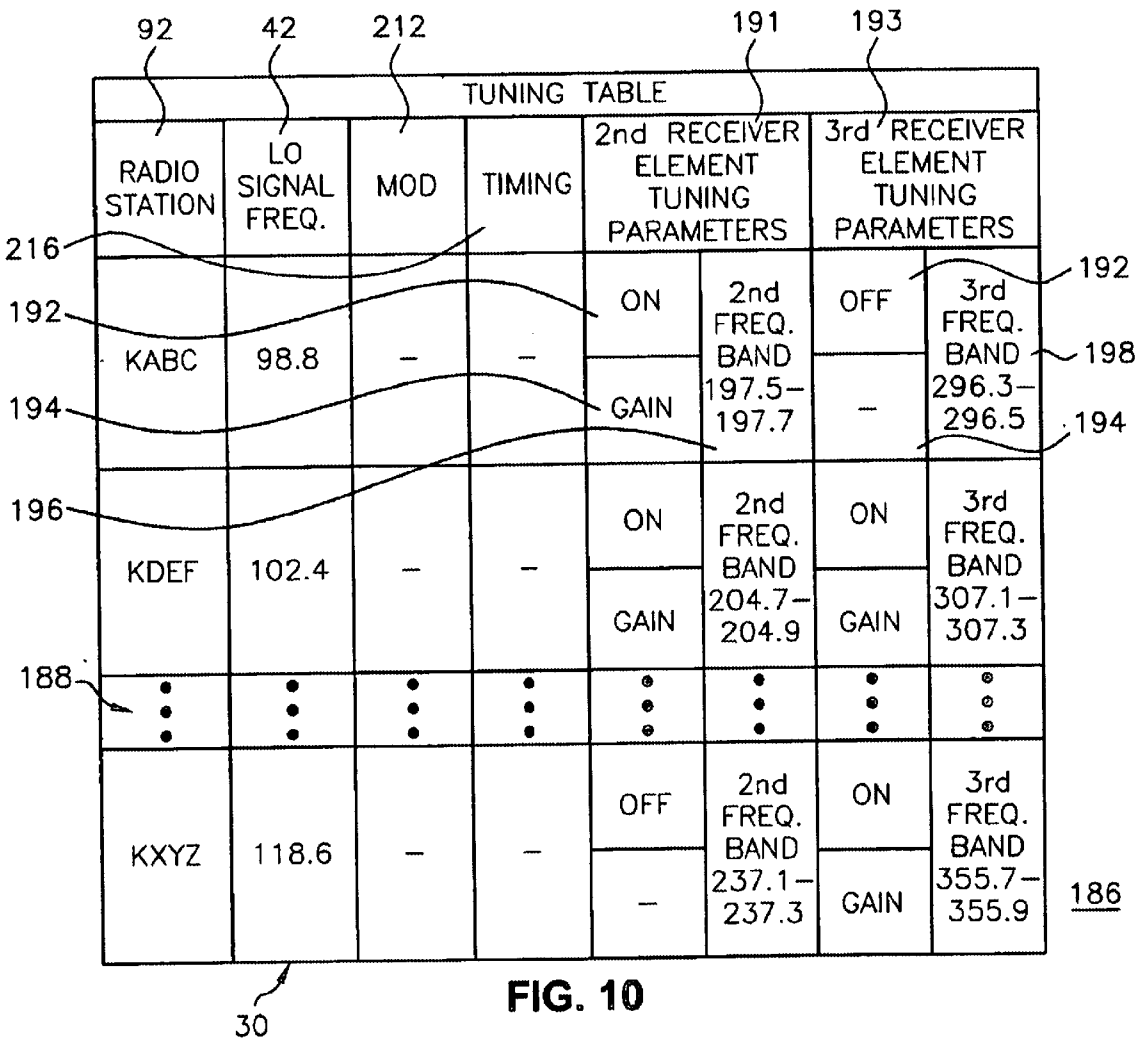
FIG. 10 shows a tuning table maintained in a memory structure within a controller portion of the active survey electronics system of FIG. 8.

Process 182 begins with a task 184 which selects a next one of local oscillator signals 30. Task 184 may consult a table when selecting a next local oscillator signal 30. Referring to FIG. 10 in connection with task 184, FIG. 10 shows a tuning table 186 which is maintained in a memory structure (not shown) within controller 58 (FIG. 8) of system 154 (FIG. 8).

Table 186 depicts an exemplary memory structure which associates radio stations 92, identified by their call letters, with their related LO signals 30. For clarity of illustration, LO signals 30 are identified in table 90 by related fundamental frequencies 42.

Tuning table 186 may include any number of radio stations 92, as indicated by ellipsis 188. However, table 186 is constructed to include only LO signals 30 corresponding to radio stations 92 which are to be included in an audience survey prepared by system 154 (FIG. 8). Typically, all radio stations 92 whose LO signals 30 are reasonably detectable at either of second harmonic 44 (FIG. 2) or third harmonic 46 (FIG. 2) in detection zone 156 (FIG. 7) are included in an audience survey. Any radio station 92 not reasonably detectable in zone 156 is omitted from table 186 and the audience survey, and preferably none of radio stations 92 are listed twice in table 186.

With reference to FIGS. 9 and 10, task 184 may move a pointer (not shown) to a next entry in table 186 to select the next one of LO signals 30. When the pointer reaches the end of table 186 it may return to the beginning of table 186.

A task 190 is performed in connection with task 184. Task 190 tunes second and third receiver elements 62 and 64 (FIG. 8) of scanning receiver 54 according to tuning parameters associated with the selected one of LO signals 30. As shown in FIG. 10, tuning table 186 includes tuning parameters 191 for second receiver element 62 (FIG. 8) and tuning parameters 193 for third receiver element 64, in association with each of LO signal fundamental frequencies 42.

Since fundamental frequency 42 of LO signals 30 is not used in this alternative embodiment, tuning table 186 need not include tuning parameters for first receiver element 60. Rather, first receiver element 60 is merely "Off" in this alternative embodiment. Of course, it should be readily apparent to those skilled in art that scanning receiver 54 need not include first receiver element 60 since this alternative embodiment of the present invention does not evaluate second signal 164 to detect fundamental frequency 42 (FIG. 2) within second signal 164.

Tuning parameters 191 and 193 represent data that serve as instructions for the control of receiver elements 62 and 64 by controller 58 (FIG. 3). For example, tuning parameters 191 for second receiver element 62 include an On/Off status 192, an amplifier gain value 194, and a second harmonic frequency band 196. Likewise, tuning parameters 193 for third receiver element 64 include On/Off status 192, amplifier gain value 194, and a third harmonic frequency band 198. The tuning parameters of tuning table 186 are desirably set for detection zone 156 (FIG. 7) when system 154 (FIG. 8) is positioned along road 22 (FIG. 7).

Figure 11:
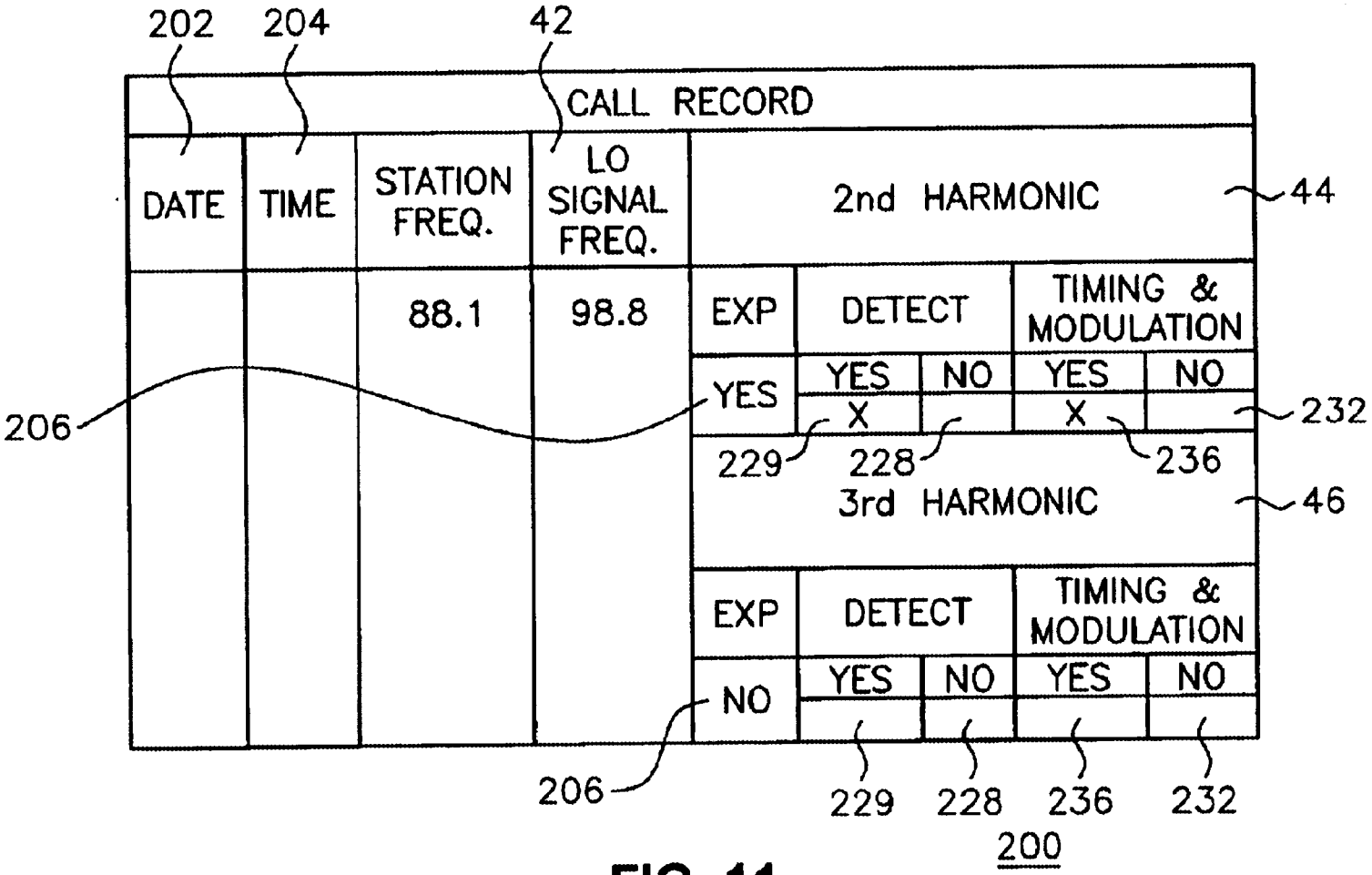
FIG. 11 shows an exemplary format for a call record logged by the controller portion of the active survey electronics system of FIG. 8.

In addition to tuning scanning receiver 54, task 190 initializes a call, or survey, record for the selected one of LO signals 30. FIG. 11 shows an exemplary format for a call record 200 initialized by controller 58 (FIG. 8) of system 154 (FIG. 8) through the execution of task 190. Call, or survey, record 200, includes data relevant to the detection of one of radio stations 92 (FIG. 10) to which one of tuners 26 (FIG. 1) may be tuned. Task 190 may, for example, record a date 202 and start time 204 for the detection of second and/or third harmonic 44 and/or 46, respectively, of the selected one of LO signals 30 within second signal 164 (FIG. 8).

Call record 200 also includes expected signal fields 206 for each of second harmonic 44 and third harmonic 46. Fields 206 are completed in response to On/Off status 192 from tuning table 186 (FIG. 10). For example, in accordance with On/Off status 192 of tuning table 186, second receiver element 62 is "ON" and third receiver element 64 is "OFF". This corresponds to the expectation that second harmonic 44 for the selected one of LO signals 30 will be detectable, and third harmonic 46 will not be detectable. As such, task 190 initializes field 206 for second harmonic 44 with "YES" and field 206 for third harmonic 46 with "NO".

Call record 200 will be completed through the further execution of process 182 (FIG. 9) and saved in a memory structure (not shown) of controller 58 (FIG. 8) if one of tuners 26 is tuned to one of radio stations 92 associated with the selected one of LO signals 30. If one of tuners 26 is not detected, call record 200 will not be completed.

Referring back to process 182 (FIG. 9), following tuning and initialization task 190, a task 208 is performed. Through control signals from controller 58 (FIG. 8), VCO 174 generates the selected one of LO signals 30 at fundamental frequency 42.

A task 210 is performed in connection with task 208. Through control signals from controller 58 (FIG. 8), the generated one of LO signals 30 is output from VCO 174 and input into modulator 176 (FIG. 8). Using modulation characteristics 212 (FIG. 10) provided in tuning table 186 (FIG. 10), modulator 176 optionally applies modulation to the generated one of LO signals 30 to form survey signal 162 (FIG. 8). Any of a wide variety of modulating techniques, including AM, FM, FSK, phase, pulse (CW), burst, sweep, none, etc. may be defined. Second and third harmonics 44 and 46 emitted from tuners 26 (FIG. 7) can be positively verified by the detection of modulation characteristics 212 within second and third harmonics 44 and 46 detected in received second signal 164 (FIG. 7).

A task 214 may be performed in connection with modulation task 210. Through control signals from controller 58 (FIG. 8), survey signal 162 is output from modulator 176 and input at switch 178 (FIG. 8). Using timing characteristics 216 (FIG. 10) provided in tuning table 186 (FIG. 10), task 214 switches switch 178 on and off to apply further modulation which pulses survey signal 162. Second and third harmonics 44 and 46 emitted from tuners 26 (FIG. 7) can be further verified by the detection of timing characteristics 216 within second and third harmonics 44 and 46 detected in received second signal 164 (FIG. 7).

Tasks 210 and 214 are performed to both modulate and further pulse the generated one of LO signals 30 to form survey signal 162. However, it should be apparent to those skilled in the art that only one of tasks 210 and 214 could be performed to incorporate unique signal identifiers into survey signal 162.

A task 218 is performed in response to task 214. Task 218 enables transmitter portion 172 to broadcast survey signal 162. Survey signal 162 is desirably broadcast as a non-interfering, very low power, e.g. fifteen milliwatt, signal on fundamental frequency 42 (FIG. 2). Survey signal 162 is desirably filtered so that substantially no second and third harmonics 44 and 46 (FIG. 2) that may be generated by signal generator portion 170 (FIG. 8) are broadcast at task 218.

A task 220 is performed in conjunction with task 218. Task 220 causes system 154 (FIG. 8) to be enabled to receive second signal 164 (FIG. 8). Task 220 may set a timer (not shown) for monitoring a duration of time during which task 218 broadcasts survey signal 162 and during which second signal 164 may be received and evaluated for second and third harmonics 44 and 46 of the selected one of LO signals 30.

In response to task 220, a query task 222 is performed. Query task 222 determines if On/Off Status 192 (FIG. 10) for second receiver element 62 (FIG. 8) is "On". When query task 222 determines On/Off Status 192 is "On", process 182 proceeds to a query task 224. Query task 224 determines if second harmonic 44 (FIG. 2) for the selected one of LO signals 30 (FIG. 2) is detected within second signal 164 (FIG. 8).

In making this determination, query task 224 may desirably evaluate a signal strength parameter to insure that the received second signal 164 exhibits an amplitude at second harmonic 44 above a predetermined minimum to reduce the likelihood of confusing a spurious signal with a legitimate call. When query task 224 determines that second harmonic 44 is not detected within second signal 164, program control proceeds to a task 226. At task 226, a negative response is logged into a negative response field 228 (FIG. 11) of call record 200 (FIG. 11) for second harmonic 44.

However, when query task 224 determines that second harmonic 44 is detected within second signal 164, an affirmative response is logged into an affirmative response field 229 (FIG. 11) of call record 200 for second harmonic 44. Program control subsequently proceeds to a query task 230. At query task 230, detector 76 (FIG. 8) of second receiver element 62 (FIG. 8), in cooperation with controller 58 (FIG. 8) verifies that the detected second harmonic 44 within second signal 164 includes timing and modulation characteristics 212 and 216, respectively (FIG. 10).

As discussed previously, survey signal 162 is produced by selecting one of LO signals 30 (FIG. 2) then applying modulation characteristics 212 and timing characteristics 216. If tuner 26 (FIG. 7) is tuned to one of radio broadcast signals 28 (FIG. 7) associated with the selected LO signal 30, survey signal 162 including modulation characteristics 212 and timing characteristics 216 will mix with LO signal 30 emitted by tuner 26. Consequently, modulation characteristics 212 and timing characteristics 216 will be expressed on second harmonic 44. When the received second signal 164 includes second harmonic 44 exhibiting modulation characteristics 212 and timing characteristics 216, a high probability exists that tuner 26 is tuned to the one of radio broadcast signals 28 currently being surveyed. Thus, modulation characteristics 212 and timing characteristics 216 serve as signal identifiers for positively verifying that second harmonic 44 within second signal 164 is being emitted from tuner 26.

When query task 230 determines that second harmonic 44 within second signal 164 does not include modulation characteristics 212 and timing characteristics 216, process 182 proceeds to task 226. At task 226, a negative response is logged into a negative response field 232 (FIG. 11) of call record 200 (FIG. 11) for second harmonic 44.

However, when query task 230 determines that second harmonic 44 within second signal 164 includes modulation characteristics 212 and timing characteristics 216, process 182 proceeds to a task 234. At task 234, an affirmative response is logged into an affirmative response field 236 (FIG. 11) of call record 200 (FIG. 11) for second harmonic 44.

Referring back to query task 222, when query task 222 determines that On/Off Status 192 (FIG. 10) for second receiver element 62 (FIG. 8) is not "On", process 182 proceeds to a query task 238. Likewise, following logging tasks 226 and 238, process 182 proceeds to query task 238.

Query task 238 determines if On/Off Status 192 (FIG. 10) for third receiver element 64 (FIG. 8) is "On". When query task 238 determines On/Off Status 192 is "On", process 182 proceeds to a query task 240. Query task 240 determines if third harmonic 46 (FIG. 2) for the selected one of LO signals 30 (FIG. 2) is detected within second signal 164 (FIG. 8). Hence, query task 240 is a similar operation to query task 224 discussed above.

When query task 240 determines that third harmonic 46 is not detected within second signal 164, program control proceeds to a task 242. At task 242, a negative response is logged into negative response field 228 (FIG. 11) of call record 200 (FIG. 11) for third harmonic 46.

However, when query task 240 determines that third harmonic 46 is detected within second signal 164, an affirmative response is logged into affirmative response field 229 for third harmonic 46. Program control subsequently proceeds to a query task 244.

At query task 244, detector 82 (FIG. 8) of third receiver element 64 (FIG. 8), in cooperation with controller 58 (FIG. 8) verifies that the detected third harmonic 46 within second signal 164 includes timing and modulation characteristics 212 and 216, respectively (FIG. 10). Hence, query task 244 is a similar operation to query task 230 discussed above. That is, when the received second signal 164 includes third harmonic 46 exhibiting modulation characteristics 212 and timing characteristics 216, tuner 26 is tuned the one of radio broadcast signals 28 currently being surveyed. Thus, modulation characteristics 212 and timing characteristics 216 serve as signal identifiers for verifying that third harmonic 46 within second signal 164 is being emitted from tuner 26.

When query task 244 determines that third harmonic 46 within second signal 164 does not include modulation characteristics 212 and timing characteristics 216, process 182 proceeds to task 242. At task 242, a negative response is logged into negative response field 232 (FIG. 11) of call record 200 (FIG. 11) for third harmonic 46.

However, when query task 244 determines that third harmonic 46 within second signal 164 includes modulation characteristics 212 and timing characteristics 216, process 182 proceeds to a task 246. At task 246, an affirmative response is logged into affirmative response field 236 (FIG. 11) of call record 200 (FIG. 11) for third harmonic 46.

Referring back to query task 238, when query task 238 determines that On/Off Status 192 (FIG. 10) for third receiver element 64 (FIG. 8) is not "On", process 182 proceeds to a query task 248. Likewise, following logging tasks 242 and 246, process 182 proceeds to query task 248.

Query tasks 224, 230, 240, and 244 and their ensuing actions serve the function of evaluating a signal, in the form of second signal 164, received at antenna 160 (FIG. 8) to determine if second signal 164 includes second harmonic 44 or third harmonic 46 of the selected one of LO signals 30. If either of second or third harmonics 44 and 46 are detected, it is further evaluated to verify that the detected second or third harmonic 44 and 46 includes modulation characteristics 212 and timing characteristics 216. Furthermore, as discussed previously, second and third receiver elements 62 and 64 (FIG. 8) operate in parallel, so that query tasks 224 and 240 are performed substantially concurrently to quickly and efficiently detect second harmonic 44 and third harmonic 46.

By modulating and pulsing survey signal 162, only signals with these modulation and timing characteristics will be identified as being from tuners tuned to a particular one of radio broadcast signals 28. Accordingly, this modulated and pulsed signal can be received and detected above, at, and slightly below the ambient interference. Furthermore, this evaluation substantially reduces reliance on "post" data collection integrity checking.

Query task 248 determines if at least one of second and third harmonics 44 and 46, respectively, was detected within second signal 164 (FIG. 8) and whether the detected one of second and third harmonics 44 and 46 includes modulation and timing characteristics 212 and 216 (FIG. 10). Controller 58 (FIG. 8) performs query task 248 by evaluating call record 200 (FIG. 11). Call record 200 is evaluated to determine that an affirmative response "X" is present in affirmative response fields 229 and 236 for those of second harmonic 44 and third harmonic 46 whose corresponding expected signal field 206 (FIG. 11) contains a "Yes".

When the expected ones of second harmonic 44 and third harmonic 46 are detected, process 182 proceeds to a task 250. Task 250 writes call record 200 (FIG. 11), initialized in task 190, to memory so that it may later be communicated to a processing center (not shown) for compilation into a survey results report. In other words, task 250 records the detection of one of tuners 26 (FIG. 1) tuned to one of the surveyed radio broadcast signals 28 (FIG. 1) through the detection of second harmonic 44 or third harmonic 46 including the signal identifiers of modulation and timing characteristics 212 and 216 for an associated one of LO signals 30. Task 250 may also add data describing a stop time, signal strength, and other factors to call record 200. Following task 250, program control loops back to task 184 to repeat process 182 for a selected next one of LO signals 30.

When query task 248 determines that the expected ones of second and third harmonics 44 and 46 are not detected, process 182 proceeds to a task 252. Task 252 clears call record 200, initialized in task 186, and program control loops back to task 184 to repeat process 182 for a selected next one of LO signals 30. In other words, no tuners 26 in detection zone 156 (FIG. 7) are tuned to the one of radio broadcast signals 28 (FIG. 7) associated with the selected one of LO signals 30.

In summary, the present invention provides an improved system and method for remotely identifying RF broadcast stations to which tuners are tuned in the presence of significant background interference. In one embodiment, the fundamental frequency, the second harmonic, and/or the third harmonic of a selected local oscillator signal emitted from the tuners are detected. The harmonics of the local oscillator signal may be more readily detected when the interference in the detection zone masks the fundamental frequency of the local oscillator signal. In an alternative embodiment, the selected one of the local oscillator signals is generated, modulated, and broadcast as a non-interfering survey signal. This survey signal mixes with the corresponding local oscillator signal emitted from a tuner. The modulation characteristics are detectable on the second and third harmonics of the local oscillator signal but are undetectable to the listener. By detecting the harmonics, the present invention identifies tuners tuned to particular radio broadcast signals above, at, and slightly below the background interference. Furthermore, by detecting the harmonics and verifying the presence of the modulation characteristics in the detected harmonics, post data collection integrity checking is substantially reduced.

Although the preferred embodiments of the invention have been illustrated and described in detail, it will be readily apparent to those skilled in the art that various modifications may be made therein without departing from the spirit of the invention or from the scope of the appended claims. For example, the scanning receiver of the present invention need not have three receiving elements but may have a single receiving element that rapidly scans the frequency bands of interest. Moreover, those skilled in the art can distribute the processing functions described herein between a receiver, a transmitter, and controller differently than indicated herein, or those skilled in the art can combine functions which are indicated herein as being performed at different components of the system. Furthermore, those skilled in the art will appreciate that the present invention will accommodate a wide variation in the specific tasks and the specific task ordering used to accomplish the processes described herein.

What is claimed is:

1. A remote audience survey method for identifying radio stations to which tuners are tuned, said tuners having predetermined signals emitted therefrom, said predetermined signals being associated with said radio stations, said method comprising:

selecting one of said predetermined signals associated with one of said radio stations, said one predetermined signal exhibiting a fundamental frequency;

receiving a second signal;

detecting a harmonic of said fundamental frequency within said second signal; and determining that one of said tuners is tuned to said one of said radio stations in response to said detecting operation.

2. A method as claimed in claim 1 wherein:

said predetermined signals are local oscillator signals; and said harmonic is one of a second harmonic and a third harmonic of said fundamental frequency.

3. A method as claimed in claim 1 wherein:

said method further comprises detecting said fundamental frequency within said second signal; and said determining operation determines that said one of said tuners is tuned to said one of said radio stations in response to said detected fundamental frequency and said harmonic.

4. A method as claimed in claim 3 further comprising concurrently detecting said fundamental frequency and said harmonic within said second signal at a receiver system.

5. A method as claimed in claim 3 comprising:

tuning, in response to said selecting operation, a first receiver element of a receiver system to detect a first band of frequencies, said fundamental frequency being within said first band; and tuning a second receiver element of said receiver system to detect a second band of frequencies, said harmonic being within said second band.

6. A method as claimed in claim 5 wherein:

said harmonic is a second harmonic;

said method further comprises:

tuning a third receiver element of said receiver system to detect a third band of frequencies, said frequencies of said third band being approximately thrice said frequencies of said first band; and detecting a third harmonic within said second signal; and said determining operation determines that said one of said tuners is tuned to said one of said radio stations in response to said detected fundamental frequency and said second and third harmonics.

7. A method as claimed in claim 1 wherein:

said harmonic is a second harmonic of said fundamental frequency;

said method further comprises detecting a third harmonic within said second signal; and said determining operation determines that said one of said tuners is tuned to said one of said radio stations in response to said detected second and third harmonics.

8. A method as claimed in claim 1 further comprising:

generating a survey signal in response to said selecting operation, said survey signal being said one of said predetermined signals modified to incorporate a signal identifier;

broadcasting said survey signal; and verifying that said detected harmonic includes said signal identifier to determine that said one of said tuners is tuned to said one of said radio stations.

9. A method as claimed in claim 8 wherein said survey signal causes said one of said tuners to emit said second signal including said signal identifier when said one tuner is tuned to said one of said radio stations.

10. A method as claimed in claim 8 wherein:

said signal identifier is a modulation characteristic;

said generating operation includes applying modulation to said one predetermined signal to incorporate said modulation characteristic; and said verifying operation verifies that said harmonic includes said modulation characteristic.

11. A method as claimed in claim 8 wherein:

said signal identifier is a timing characteristic;

said generating operation includes pulsing said one predetermined signal to incorporate said timing characteristic; and said verifying operation verifies that said harmonic includes said timing characteristic.

12. A method as claimed in claim 8 wherein:

said harmonic is a second harmonic of said fundamental frequency;

said method additionally comprises detecting a third harmonic of said fundamental frequency within said second signal; and said verifying operation further verifies that said third harmonic includes said signal identifier to determine that said one of said tuners is tuned to said one of said radio stations.

13. A remote audience survey system for identifying a radio station to which a tuner is tuned, said tuner having local oscillator (LO) signals emitted therefrom, and said system comprising:

a controller configured to select one of said LO signals associated with said radio station, said one LO signal exhibiting a fundamental frequency;

an antenna configured to receive a second signal; and a receiver in communication with said antenna and said controller, said receiver being configured to detect a harmonic of said fundamental frequency within said second signal to determine that said tuner is tuned to said radio station.

14. A system as claimed in claim 13 wherein said receiver comprises:

a first receiver element tuned to receive a first band of frequencies in response to first control signals provided by said controller, said fundamental frequency being within said first band; and a second receiver element tuned to receive a second band of frequencies in response to second control signals provided by said controller, said harmonic being within said second band.

15. A system as claimed in claim 13 wherein:

said harmonic is a second harmonic of said fundamental frequency; and said receiver further includes a third receiver element tuned to receive a third band of frequencies in response to third control signals provided by said controller, said third receiver element being configured to detect a third harmonic of said fundamental frequency within said second signal.

16. A system as claimed in claim 13 further comprising:

a signal generator in communication with said controller, said signal generator being configured to modify said one of said LO signals to incorporate a signal identifier in response to control signals provided by said controller; and a transmitter coupled to said signal generator and configured to broadcast said modified LO signal, said modified LO signal being configured to cause said tuner to emit said second signal including said signal identifier when said tuner is tuned to said radio station.

17. A system as claimed in claim 16 wherein:

said signal identifier is a modulation characteristic;

said signal generator modulates said one of said LO signals to incorporate said modulation characteristic; and said receiver is further configured to verify that said detected harmonic includes said modulation characteristic.

18. A system as claimed in claim 16 wherein:

said signal identifier is a timing characteristic;

said signal generator pulses said one of said LO signals to incorporate said timing characteristic; and said receiver is further configured to verify that said detected harmonic includes said timing characteristic.

19. A remote audience survey method for identifying radio stations to which tuners are tuned, said tuners have local oscillator (LO) signals emitted therefrom, said method comprising:

selecting a first one of said LO signals, said first LO signal exhibiting a fundamental frequency;

receiving a second signal at a receiver;

detecting a second harmonic of said fundamental frequency within said second signal;

detecting a third harmonic of said fundamental frequency within said second signal; and determining one of said tuners is tuned to said one of said radio stations in response to said detected second and third harmonics.

20. A method as claimed in claim 19 further comprising:

tuning a first receiver element of a receiver system to detect a first band of frequencies, said fundamental frequency being within said first band;

detecting said fundamental frequency within said second signal at said first receiver element;

tuning a second receiver element of said receiver system to detect a second band of frequencies, said second harmonic being within said second band;

tuning a third receiver element of said receiver system to detect a third band of frequencies, said third harmonic being within said third band; and said determining operation determines that said one of said tuners is tuned to said one of said radio stations in response to said detected fundamental frequency and said second and third harmonics.

21. A method as claimed in claim 19 further comprising:

generating, in response to said selecting operation, a survey signal by modifying said one of said LO signals to incorporate a signal identifier;

broadcasting said survey signal; and verifying that said second and third harmonics include said signal identifier to determine that said one of said tuners is tuned to said one of said radio stations.

* * * * *